US006546579B1

(12) United States Patent
Leventhal et al.

(10) Patent No.: US 6,546,579 B1
(45) Date of Patent: Apr. 15, 2003

(54) CONFORMING AIR AND FOAM SUPPORT DEVICE

(75) Inventors: Robert D. Leventhal, Los Angeles, CA (US); Paul B. Thomas, San Pedro, CA (US)

(73) Assignee: D2RM Corp., Gardena, CA (US)

( * ) Notice: Subject to any disclaimer, the term of this patent is extended or adjusted under 35 U.S.C. 154(b) by 57 days.

(21) Appl. No.: 09/803,581

(22) Filed: Mar. 9, 2001

Related U.S. Application Data

(60) Provisional application No. 60/193,778, filed on Mar. 31, 2000.

(51) Int. Cl.[7] ..... A47C 27/08; A47G 9/00

(52) U.S. Cl. ..... 5/655.3; 644/654; 644/706; 644/712; 297/452.41

(58) Field of Search ..... 5/655.3, 644, 706, 5/654, 712; 297/452.41

(56) References Cited

U.S. PATENT DOCUMENTS 2,521,530 A * 9/1950 McGuffage ..... 5/655.3
2,942,281 A * 6/1960 Cole ..... 5/644
3,298,044 A * 1/1967 Saltness et al. ..... 5/644
D340,379 S * 10/1993 Cain ..... 5/654
6,327,725 B1 * 12/2001 Veilleux et al. ..... 5/644

FOREIGN PATENT DOCUMENTS

FR 2602175 A1 * 2/1988 ..... 5/712
GB 2134383 A * 8/1984 ..... 5/644

* cited by examiner

*Primary Examiner*—Alexander Grosz

(57) ABSTRACT

A conforming air and foam support device for providing support to a body or a body part of an individual, where the conforming shape of the support device suspends the foam in order to cradle the body or the body part of the individual sitting or resting on the support device. The support device has an air bladder structure with at least one central opening and at least two foam slab members being slightly longer and wider than the air bladder structure. The air bladder structure is sandwiched between the at least two slab members, where the two foam slab members are bonded to the air bladder structure in the deflated condition as well to each other at the central opening to form the conforming air and foam support device. Once the air bladder structure is inflated, the upper foam slab member forms at least one concave surface while the lower foam slab member forms at least one convex surface at the central portions in order to cradle the body or the body part of an individual.

33 Claims, 5 Drawing Sheets

CONFORMING AIR AND FOAM SUPPORT DEVICE

This is a Patent Application of a Provisional Application Serial No. 60/193,778 filed on Mar. 31, 2000, now pending.

BACKGROUND OF THE INVENTION

1. Field of the Invention

The present invention generally relates to the field of support devices. More particularly, the present invention relates to the field of support devices that utilize an air and foam structure for cradling a body part of an individual positioned on the support device.

2. Description of the Prior Art

Specifically, support devices such as pillows, mattresses, seat toppers, seat cushions, chairs and etc. are well known in the art. These support devices are usually constructed utilizing only one type of material in them. Therefore, these prior art support devices do not provide adequate support to a body part of an individual to make them effective.

It is desirable to provide a very efficient and also very effective design and construction of a conforming air and foam support device for providing comfort and tranquillity to a user during use. It is also desirable to provide a conforming air and foam support device that not only supports a body part of an individual who sits or rests on the support device but also provides a conforming shaped structure which cradles the body part of the individual sitting or resting on the support device.

SUMMARY OF THE INVENTION

The present invention is a conforming air and foam support device for providing support to a body part of an individual, where the conforming shape of the support device suspends the foam in order to cradle the body part of the individual sitting or resting on the support device.

The support device comprises an air bladder structure with a central opening and two foam slab members being slightly longer and wider than the air bladder structure. The air bladder structure is sandwiched between the two slab members, where the two foam slab members are bonded to the air bladder structure in the deflated condition as well to each other at a central portion to form the conforming air and foam support device. Once the air bladder structure is inflated, the upper foam slab member forms a concave surface while the lower foam slab member forms a convex surface at the central portions in order to cradle the body part of an individual.

It has been discovered, according to the present invention, that by providing an air and foam support device that utilizes an air bladder structure sandwiched between two foam slab members, the air bladder design when inflated shapes and suspends the foam slab members in order to cradle a body part of a user.

It is an object of the present invention to provide an air and foam support device wherein the construction of the air and foam support device provides a resting or therapeutic structure formed by cradling the body part of an individual. Pressure exerted upwardly against the weight of a resting body by the air bladder structure can be adjusted to be firmer or softer.

It is also an object of the present invention to provide an air and foam support device which includes an air bladder structure sandwiched and bonded between two foam slab members, where portions of the slab members are separated by the inflated air bladder structure in order to create an adjustable and variable support and enhance conformability.

It is an additional object of the present invention to provide an air and foam support device, where the foam shape conforms to the air bladder structure and suspends and supports the foam in a trampoline manner between the hollow air chamber of the air bladder structure.

It is a further object of the present invention to provide an air and foam support device that is cost effective.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
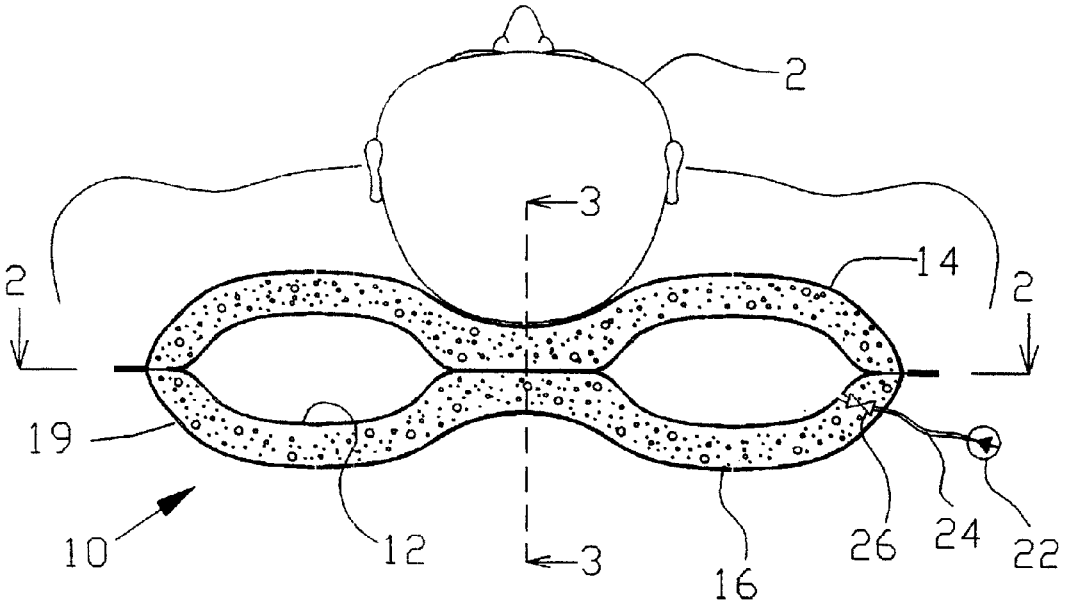
FIG. 1 is an illustrative diagram showing a preferred embodiment of the present invention air and foam support device utilized as a pillow, showing an air bladder structure inflated and sandwiched between two foam slab members for supporting the head of a user.

Referring to FIG. 1, there is shown at 10 the present invention air and foam support device utilized as a pillow support positioned underneath a head or body part of an individual 2.

Figure 2:
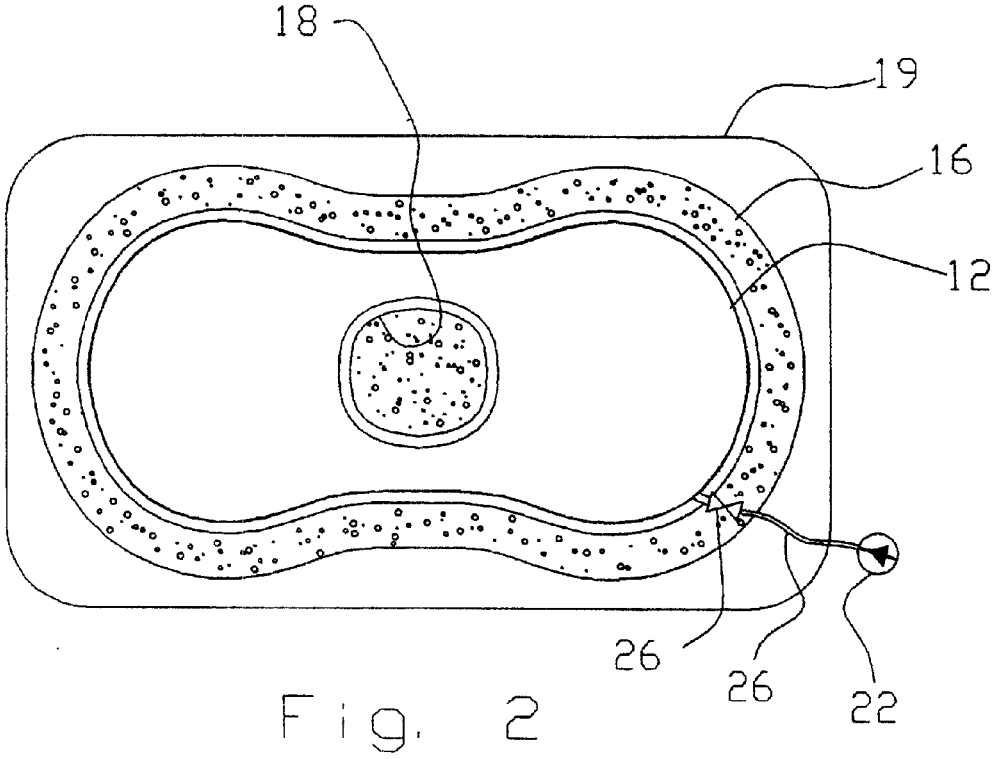
FIG. 2 is a cross-sectional view taken along line 2—2 of FIG. 1.

Referring to FIGS. 1 and 2, the air and foam support device 10 comprises air bladder structure 12 and two foam slab members 14 and 16. A skin or cover 19 is provided with the device and completely encloses the air bladder structure 12 and the two foam slab members 14 and 16. The skin 19 is made out of a fabric material or any suitable material known to one skilled in the art.

Figure 4:
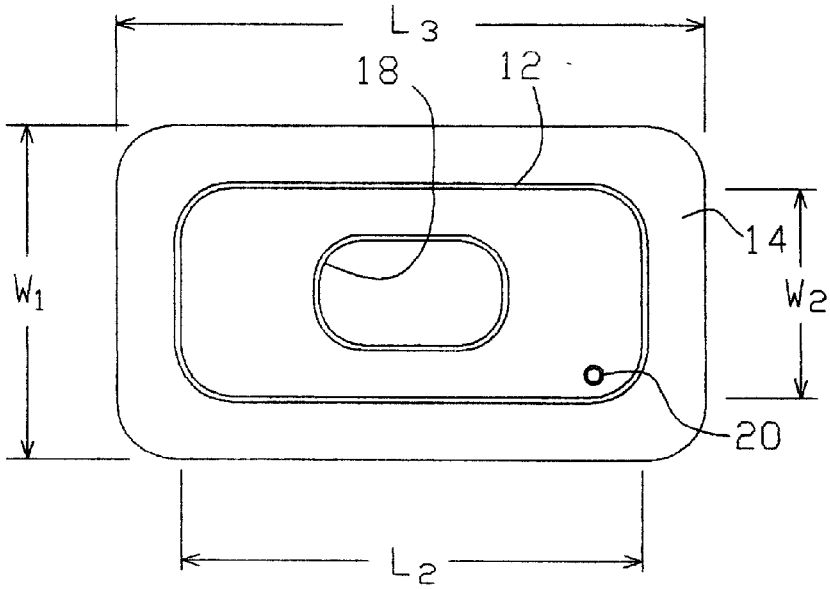
FIG. 4 is a top plan view of the present invention air and foam support device in the deflated condition.

The air bladder structure 12 is constructed from a material that is airtight and has a generally elliptical shaped structure with a circular shaped aperture 18 in a deflated condition (see FIG. 4). It will be appreciated that the air bladder structure 12 may be any suitable shape known to one skilled in the art. By way of example, the air bladder structure 12 can be rectangular shape, oval shape or any other geometric shape.

When the air bladder structure 12 is in the inflated condition, the aperture 18 forms an elliptical shape as shown in FIG. 2. The air bladder structure 12 has an inlet/outlet port 20 attached to the exterior surface of the structure 12 and communicating with the air chamber. The port 20 is interconnected to a valve 26 which is connected to pneumatic supply means 22 by a conduit or tubing 24 for pressurizing and depressurizing the air bladder 12. The pneumatic supply means 22 may be supplied by 110V AC powered or DC powered, such as batteries. The air and foam support structure 10 may further include control means (not shown) having control circuitry (not shown) for controlling inflation and deflation of the air bladder structure 12.

Figure 3:
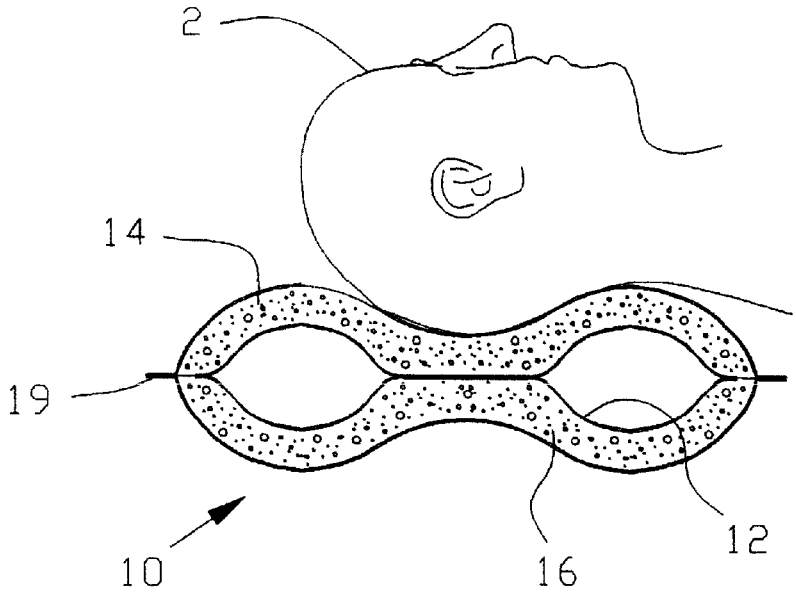
FIG. 3 is a cross-sectional view taken along line 3—3 of FIG. 1.

Referring to FIGS. 2 and 4, each foam slab member has a length ($L_1$) and width ($W_1$) that are slightly larger than the length ($L_2$) and width ($W_2$) of the air bladder structure 12. Each foam slab member has four rounded comers to provide an aesthetic structure. The air bladder structure 12 is sandwiched and bonded between the interior surfaces of the two foam slab members 14 and 16 prior to inflation of the air bladder structure 12. When the air bladder structure 12 is inflated, portions of the foam slab members 14 and 16 are separated by the inflated air chamber of the air bladder structure 12 in order to create an adjustable and variable support and enhance conformability. The foam slab members 14 and 16 conform to the air bladder structure 12 such that the air bladder structure 12 suspends and supports the foam slab members 14 and 16 in a trampoline manner between the hollow air chamber within the air bladder 12 (see FIG. 3).

Figure 5:
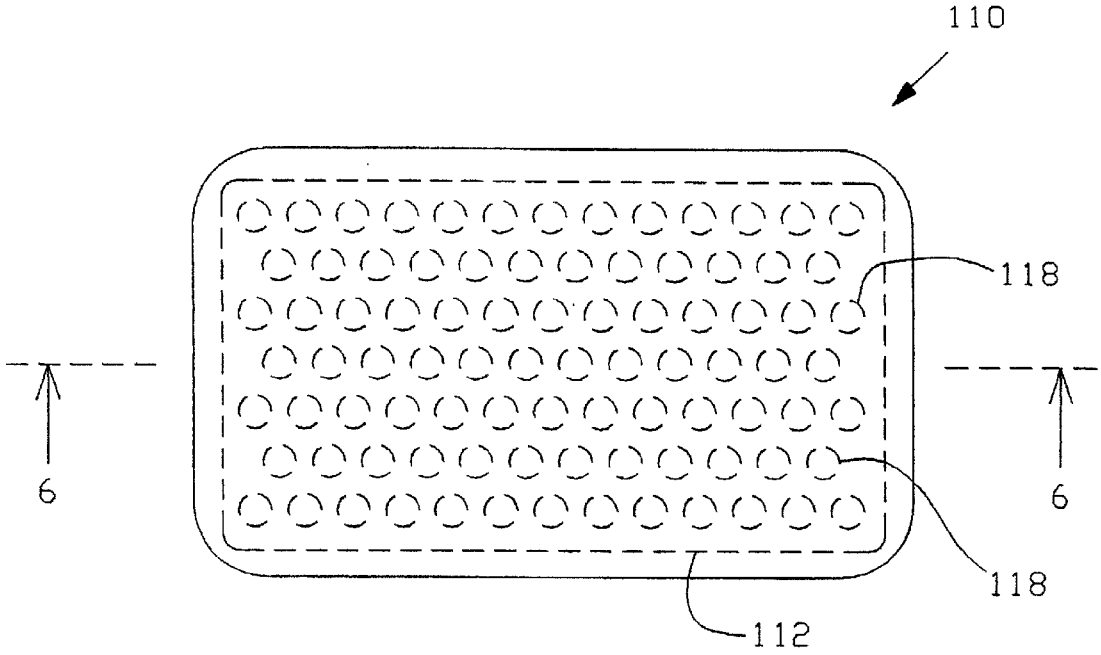
FIG. 5 is an illustrative diagram showing a second embodiment of the present invention air and foam support device incorporated within a mattress or padding.
Figure 6:
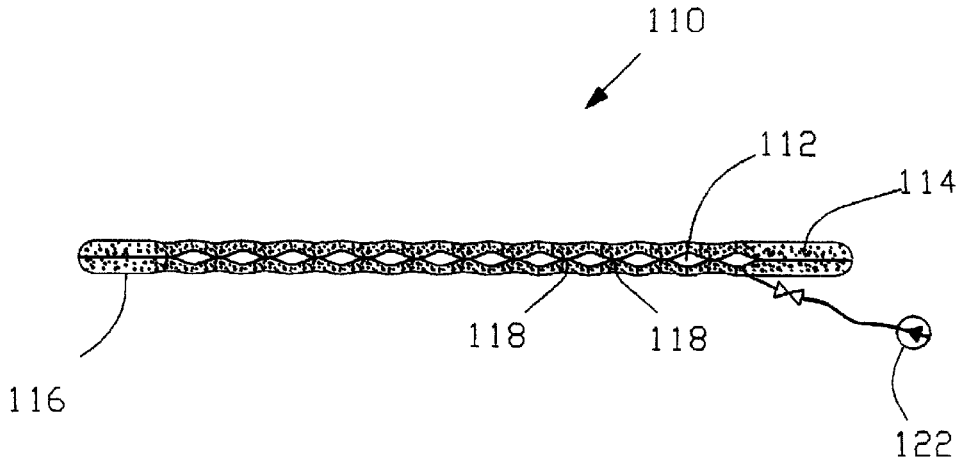
FIG. 6 is a cross-sectional view taken along line 6—6 of FIG. 5.

The present invention has many advantageous features including: (a) the air bladder structure maintains the shape at low inflate and still provides support; (b) the air bladder design shapes and suspends the foam slab members in order to cradle a body part of an individual; and (c) the air bladder is adjustable to make the structure firmer or softer The above-described embodiment of the present invention conforming air and foam support device 10 can be implemented in many applications. Referring to FIGS. 5 and 6, there is shown one of the many applications of the present invention air and foam support device incorporated into a mattress 110. In this second embodiment, an enlarged air bladder structure 112 is sandwiched between two enlarged foam slab members 114 and 116, wherein a plurality of bonded sections 118 of the two foam slab members 114 and 116 create a trampoline effect between the hollow air chamber formed by the air bladder structure 112. A skin or cover is provided with the device and completely encloses the air bladder structure 112 and the two foam slab members 114 and 116.

The mattress 110 further includes control means 122 for inflating and deflating the enlarged air bladder structure 112.

Figure 7:
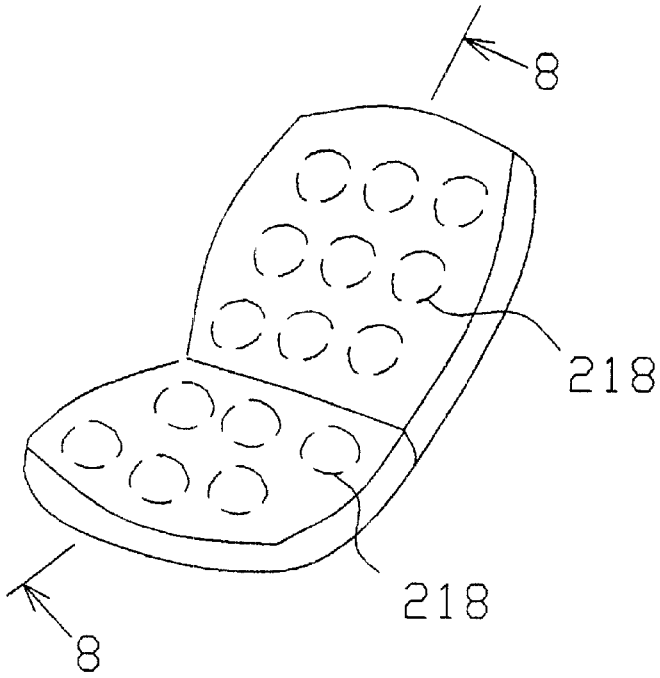
FIG. 7 is an illustrative diagram showing a third embodiment of the present invention air and foam support device incorporated within a seat topper.
Figure 8:
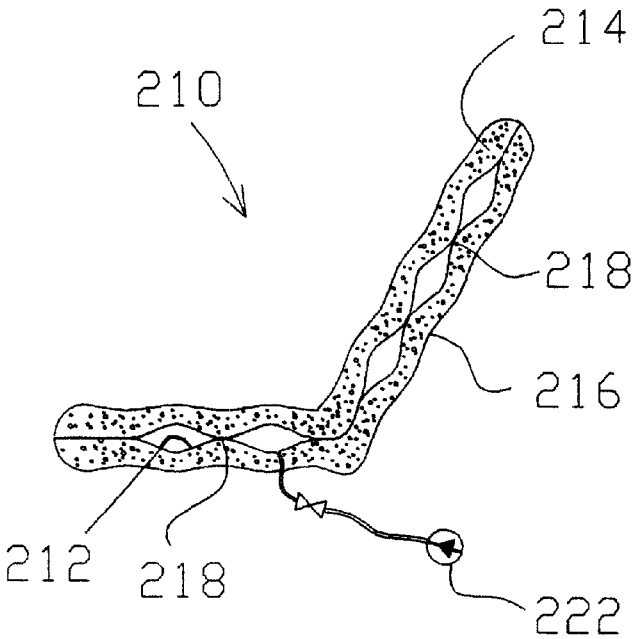
FIG. 8 is a cross-sectional view taken along line 8—8 of FIG. 7.

Referring to FIGS. 7 and 8, there is shown another application of the present invention air and foam support device incorporated into a portable seat topper 210 which includes a back section, and a buttock and thigh section. In this third embodiment, an enlarged air bladder structure 212 is sandwiched between two enlarged foam slab members 214 and 216, wherein a plurality of bonded sections 218 of the two foam slab members 214 and 216 create a trampoline effect between the hollow air chamber formed by the air bladder structure 212. A skin or cover is provided with the device and completely encloses the air bladder structure 212 and the two foam slab members 214 and 216. The seat topper 210 further includes control means 222 for controlling the inflation and deflation of the enlarged air bladder structure 212.

Figure 9:
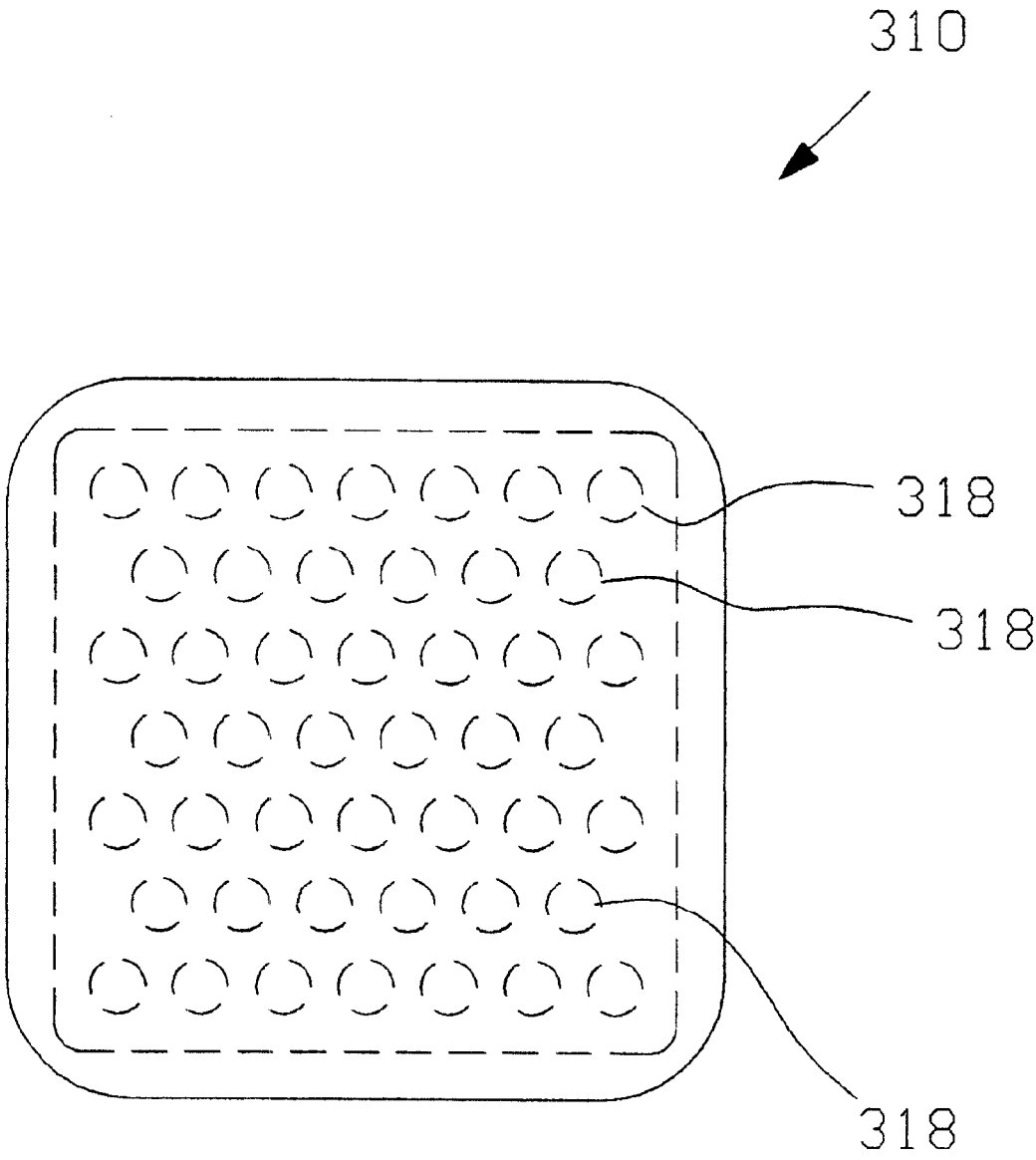
FIG. 9 is an illustrative diagram showing a fourth embodiment of the present invention air and foam support device incorporated within a wheelchair seat cushion.

Referring to FIG. 9, there is shown still another application of the present invention air and foam support device incorporated into a wheelchair seat cushion 310 that may be placed on a wheelchair, a car seat or a conventional chair. The wheelchair seat cushion 310 includes an air bladder structure 312 sandwiched between two foam slab members, wherein a plurality of bonded sections 318 of the two foam slab members 314 and 316 create a trampoline effect between the hollow air chamber formed by the air bladder structure 312. A skin or cover is provided with the device and completely encloses the air bladder structure 312 and the two foam slab members. The wheelchair seat cushion 310 further includes control means for controlling the inflation and deflation of the air bladder structure 312.

It will be appreciated that the air and foam support device 10 shown in FIGS. 1 through 10 are not limited to these applications shown. It is emphasized that while the applications shown in FIGS. 1 through 10 are preferred, it is also within the spirit and scope of the present invention to have many other different types of applications not shown.

The air and foam support structure 10 conforms to conventional forms of manufacture, or any other conventional way known to one skilled in the art. The manufacturing process which could accommodate the construction of the present invention air and foam support structure 10 may be injection, thermoform, etc. or other molding process. By way of example, the air bladder structure 12 can be made from urethane material, vinyl material or any other suitable material, while the foam slab members are made from inexpensive foam material.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. An air and foam support device for supporting a body part of an individual, comprising:

a. an airtight bladder structure having a central opening and an adjustable air chamber surrounding the central opening;

b. a pair foam slab members each having a length and width which are slightly larger than the length and width of said airtight bladder structure;

c. said air bladder structure sandwiched and attached between the interior surfaces of said pair of foam slab members, with said foam slab members attached to each other at said central opening prior to inflating of said air chamber, and when said air chamber is inflated, portions of said pair of foam slab members are separated by the inflation of said air chamber in order to create an adjustable and variable support, where said pair of foam slab members conform to the shape of the inflated said bladder structure such that said airtight bladder structure suspends and supports said pair of foam slab members in a trampoline manner between said air chamber; and d. means for inflating or deflating said air chamber of said airtight bladder structure.

2. The support device in accordance with claim 1, further comprising a cover for completely covering said support device.

3. The support device in accordance with claim 2, wherein said cover is made of fabric material.

4. The support device in accordance with claim 1, wherein said means for inflating or deflating includes a port connected to said air chamber and which is interconnected to a valve which is connected to pneumatic supply.

5. The support device in accordance with claim 1, wherein said pair of foam slab members have rounded corners.

6. The support device in accordance with claim 1, wherein said airtight bladder structure is made of urethane material.

7. The support device in accordance with claim 1, wherein said airtight bladder structure is made of vinyl material.

8. A support device for supporting a body part of an individual, comprising:

a. a bladder structure having a central opening and an adjustable hollow chamber surrounding the central opening;

b. at least two slab members each having a length and width which are slightly larger than the length and width of said bladder structure;

c. said bladder structure sandwiched and attached between the interior surfaces of said at least two slab members, with said slab members attached to each other at said central opening prior to inflating of said hollow chamber, and when said hollow chamber is inflated, portions of said at least two slab members are separated by the inflation of said hollow chamber, where said at least two slab members conform to the shape of the inflated said bladder structure such that said bladder structure suspends and supports said at least two slab members in a trampoline manner between said hollow chamber; and d. means for inflating or deflating said hollow chamber of said bladder structure.

9. The support device in accordance with claim 8, further comprising a cover for completely covering said support device.

10. The support device in accordance with claim 9, wherein said cover is made of fabric material.

11. The support device in accordance with claim 8, wherein said means for inflating or deflating includes a port connected to said hollow chamber and which is interconnected to a valve which is connected to pneumatic supply.

12. The support device in accordance with claim 8, wherein said bladder structure is made of urethane material.

13. The support device in accordance with claim 8, wherein said bladder structure is made of vinyl material.

14. The support device in accordance with claim 8, wherein said at least two slabs members are made of foam material.

15. A support device for supporting a body part of an individual, comprising:

a. a bladder structure having at least one opening and at least one hollow chamber surrounding the at least one opening;

b. at least one flexible slab member comprising an upper and a lower portion sandwiching said bladder structure at said at least one opening prior to inflating of said at least one hollow chamber, said upper and lower portions of said at least one flexible slab member being attached to each other at said at least one opening, and when said at least one hollow chamber is inflated, portions of the at least one flexible slab member are separated by the inflation of said at least one hollow chamber, where the at least one slab member conforms to the shape of the inflated said bladder structure; and c. means for inflating or deflating said at least one hollow chamber of said bladder structure.

16. The support device in accordance with claim 15, further comprising a cover for completely covering said support device.

17. The support device in accordance with claim 16, wherein said cover is made of fabric material.

18. The support device in accordance with claim 15, wherein said means for inflating or deflating includes a port connected to said at least one hollow chamber and which is interconnected to a valve which is connected to pneumatic supply.

19. The support device in accordance with claim 15, wherein said bladder structure is made of urethane material.

20. The support device in accordance with claim 15, wherein said at least one slab member is made of foam material.

21. A support device for supporting a body part of an individual, comprising:

a. a bladder structure having a plurality of spaced apart openings and a plurality of adjustable hollow chambers respectively surrounding the plurality of openings, the plurality of hollow chambers interconnected to each other;

b. at least two slab members each having a length and width which are slightly larger than the length and width of said bladder structure;

c. said bladder structure sandwiched and attached between the interior surfaces of said at least two slab members, with said slab members attached to each other at said plurality of openings prior to inflating of said plurality of hollow chambers, and when said plurality of hollow chambers are inflated, portions of said at least two slab members are separated by the inflation of said plurality of hollow chambers, where said at least two slab members conform to the shape of the inflated said bladder structure such that said bladder structure suspends and supports said at least two slab members in a trampoline manner between said plurality of hollow chambers; and d. means for inflating or deflating said plurality of hollow chambers of said bladder structure.

22. The support device in accordance with claim 21, further comprising a cover for completely covering said support device.

23. The support device in accordance with claim 22, wherein said cover is made of fabric material.

24. The support device in accordance with claim 21, wherein said means for inflating or deflating includes a port connected to one of said plurality of hollow chambers and which is interconnected to a valve which is connected to pneumatic supply.

25. The support device in accordance with claim 21, wherein said bladder structure is made of urethane material.

26. The support device in accordance with claim 21, wherein said bladder structure is made of vinyl material.

27. The support device in accordance with claim 21, wherein said at least two slab members are made of foam material.

28. A support device for supporting a body part of an individual, comprising:

a. a bladder structure having a plurality of spaced apart opening and a plurality of hollow chambers respectively surrounding the plurality of spaced apart openings, the plurality of hollow chambers interconnected to each other;

b. at least one flexible slab member, comprising an upper and a lower portion, sandwiching said bladder structure prior to inflating of said plurality of hollow chambers, said upper and lower portions of the at least one flexible slab member being attached to each other at said spaced apart openings and when said plurality of hollow chambers are inflated, portions of the at least one flexible slab member are separated by the inflation of said plurality of hollow chambers, where the at least one slab member conforms to the shape of the inflated said bladder structure; and c. means for inflating or deflating said plurality of hollow chambers of said bladder structure.

29. The support device in accordance with claim 28, further comprising a cover for completely covering said support device.

30. The support device in accordance with claim 29, wherein said cover is made of fabric material.

31. The support device in accordance with claim 28, wherein said means for inflating or deflating includes a port connected to said plurality of hollow chambers and which is interconnected to a valve which is connected to pneumatic supply.

32. The support device in accordance with claim 28, wherein said bladder structure is made of urethane material.

33. The support device in accordance with claim 28, wherein said at least one slab member is made of foam material.

* * * * *